US007928329B2

(12) United States Patent
Findeisen

(10) Patent No.: US 7,928,329 B2
(45) Date of Patent: Apr. 19, 2011

(54) TAP CHANGER

(75) Inventor: Jörg Findeisen, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 638 days.

(21) Appl. No.: 11/994,351

(22) PCT Filed: Jun. 28, 2006

(86) PCT No.: PCT/EP2006/063612
§ 371 (c)(1),
(2), (4) Date: Dec. 31, 2007

(87) PCT Pub. No.: WO2007/003537
PCT Pub. Date: Jan. 11, 2007

(65) Prior Publication Data

US 2008/0198569 A1 Aug. 21, 2008

(30) Foreign Application Priority Data

Jun. 30, 2005 (DE) ..... 10 2005 031 359

(51) Int. Cl.
*H01H 19/02* (2006.01)

(52) U.S. Cl. ..... 200/11 TC; 174/8

(58) Field of Classification Search ..... 200/11 TC, 200/34
See application file for complete search history.

(56) References Cited

U.S. PATENT DOCUMENTS 5,324,886 A * 6/1994 Nakatake et al. ..... 174/12 R

* cited by examiner

*Primary Examiner* — Renee Luebke
*Assistant Examiner* — Marina Fishman
(74) *Attorney, Agent, or Firm* — Laurence A. Greenberg; Werner H. Stemer; Ralph E. Locher

(57) ABSTRACT

A tap changer is filled with an insulating liquid as well as devices for absorbing variations in the volume of the insulating liquid due to thermal conditions. A gas cushion is provided which is integrated into the tap changer vessel and is formed by members that absorb the variations in the volume of the insulating liquid by changing the shape thereof. Furthermore, a gas cushion envelope is provided which prevents the gas of the gas cushion to be mixed with the gases generated by the thermal decomposition of the insulating liquid.

18 Claims, 5 Drawing Sheets

TAP CHANGER

BACKGROUND OF THE INVENTION

FIELD OF THE INVENTION

The invention relates to a tap changer filled with an insulating liquid and devices for absorbing the thermally induced volume fluctuations of this insulating liquid.

The invention makes it possible to hermetically seal the switch vessel and therefore considerably reduce the aging of the switch oil.

The use of the arrangement according to the invention furthermore makes it possible to dispense with dehumidifiers, an external expansion vessel and associated pipelines. Furthermore, the invention solves the problem of the accumulation of gases in the pipeline to the expansion vessel of hermetically sealed switches.

Tap changers of the type mentioned above are predominantly used in power transformers for regulating the voltage on load. During operation, considerable temperature fluctuations result from heating of the transition resistors, heat emission by the insulating and cooling medium of the transformer surrounding the switch and its vessel, and further influences. These bring about significant changes in the volume of the insulating liquid of the tap changer. Furthermore, thermal decomposition of the insulating liquid and resultant gas development result from switching arcs and/or heating of the transition resistors. These gases rise upward as a result of their lower density and need to be discharged by means of suitable measures.

The prior art involves the use of expansion vessels, which are fitted above the transformer and are connected to the switch via a suitable pipeline. Both the flow of insulating liquid in the case of thermally induced changes in volume and the transport away of the gases take place via this pipeline.

It is known to use a common expansion vessel for the transformer and the switch, but this results in mixing of the insulating liquids. At present predominantly a two-chamber expansion vessel is therefore used. Such expansion vessels are described, for example, in DE19527763C2.

One disadvantage of these expansion vessels is the contact between the oil surface and the outside air, which requires the use of so-called dehumidifiers. In these dehumidifiers, the air is passed over a desiccant and thereby dehumidified. This depletes the absorption capacity of the desiccant (hygroscopicity), and the desiccant needs to be replaced regularly. The periodically required visual inspections and the regular replacement of the desiccant, in particular in areas of high humidity, represent a considerable cost factor (recommended maintenance interval: 3 months). These dehumidifiers furthermore do not provide safe sealing from the absorption of moisture and oxygen by the insulating liquid, in particular when the transformer cools quickly.

DE10010737A1 describes a hermetically sealed transformer which provides an expansible radiator for volume compensation. The use of such a radiator for compensating for the volume expansion of the insulating liquid of the switch requires considerable complexity and entails problems when discharging gases from the switch vessel. For the expansion of the insulating liquid of transformers, expansion vessels are known which use a diaphragm for separating the insulating liquid from the ambient air in the main chamber. Such an expansion vessel is described in DE3206368. Although these expansion vessels provide safe sealing of the insulating liquid from the ambient air, they nevertheless require a dehumidifier, which has the associated drawbacks already mentioned.

In addition, the contact with the ambient air results in aging of the diaphragm and therefore gives rise to technical uncertainties.

It is also known to use gas cushions directly beneath the cover of transformers (DE710389). However, this solution provides no possible way of separating harmful gases from the gas cushion.

DE10224074A1 has described an arrangement for the pipeline leading into the tap changer, which arrangement uses a labyrinth system for avoiding the flow of gases to the expansion vessel.

However, this system neither provides hermetic sealing of the switch nor allows the penetration of gases into the pipeline to be completely prevented. The complex pipeline arrangement to the oil expansion vessel is also still required.

In addition, DE3504916C2 has disclosed an expansion vessel, which is fitted directly on the tap changer head. This solution likewise requires a dehumidifier, which results in the known disadvantages which have already been mentioned at the outset.

A hermetic seal can not be achieved by these means, either.

BRIEF SUMMARY OF THE INVENTION

The invention described in the text which follows allows for compensation of the change in volume of the insulating liquid during operation of the switch, whilst avoiding the above-mentioned disadvantages.

The present invention uses a gas cushion for absorbing the thermally induced volume fluctuations in the insulating liquid of the switch. In accordance with the invention, this gas cushion is integrated in the switch vessel. The switch vessel is hermetically sealed both with respect to the atmosphere and with respect to the insulating medium of the transformer. Furthermore, the gas cushion is separated from the insulating liquid by a flexible wall. The gas cushion is located in displacement bodies, which, by changing their shape and size, absorb the volume fluctuations of the insulating liquid.

The separation of the insulating liquid from the gas cushion which is brought about by the flexible wall of the displacement bodies causes the effect in accordance with the invention of gas contained in the gas cushion not mixing with the gases produced by thermal decomposition of insulating liquid. The gas cushions for volume compensation are arranged in such a way in accordance with the invention that they do not prevent the gases produced by switching arcs and/or by heating of the transition resistors from rising and being discharged.

As a result of this arrangement according to the invention, the compensation body is part of the switch. Additional, external components are dispensed with and result in a simplification of the entire transformer. Problems associated with gas accumulations in pipelines and the flow of oil being impeded in the case of temperature changes in the insulating liquid are ruled out as a result of the components affected by these problems being dispensed with.

As a result, operational faults are avoided as a result of gas cushions in conjunction with the expansion vessel in hermetic transformers. In addition, this design makes it possible to provide a special gas collection area, which prevents the pressure relief valve from responding too frequently and the additional loss of oil which is often associated with this.

In a further embodiment, the upper region of the switch is provided with an additional volume for accommodating a certain quantity of additional insulating liquid in order to replace the oil lost during decomposition as a result of switching operations and/or heating of the transition resistors. The gas resulting in the case of oil decomposition rises upward and collects in this additional area. The considerably larger gas volume results in an excess pressure in the switch vessel. If the pressure in the switch exceeds a predetermined limit value, the pressure relief valve, which is closed during normal operation, opens and provides pressure relief with the atmosphere surrounding the switch.

The inventive design of the volume compensating device allows the insulating liquid of the switch to be sealed completely from the atmosphere/ambient air. The absorption of moisture and oxygen by the insulating liquid is prevented. Any influence on the electric strength of the insulating liquid by means of moisture is prevented, and aging of the insulating liquid is significantly reduced.

The outer expansion vessel, the dehumidifier and the associated pipelines can be dispensed with. It is possible to eliminate the regular checking of the state of the desiccant in the dehumidifier, and this results in cost savings owing to the fact that the costly, regular replacement of the desiccant is dispensed with. Environmental pollution and disposal problems as a result of used desiccants are avoided.

Advantageously, the switch according to the invention is equipped with a gas outlet valve (D3). This can expediently be designed or controlled in such a way that it responds in the case of a low gas pressure, but not when an insulating liquid is present. This makes it possible for the gases to be continuously pumped away. A pressure valve and/or a conventional large-area pressure relief valve (D2) is used for protection against excess pressure. As a result of the combination of a pressure relief device which is independent of the fill level and a pressure relief device which is dependent on the fill level and responds even in the case of a low excess pressure, safe anti-bursting means can be made possible for the switch vessel in the case of gases which are formed being discharged continuously.

The rate of the necessary volume compensation during heating is dependent on the thermal time constants of the transformer and of the switch and the operating conditions, but in any case takes place very slowly. In order to keep surging changes in volume (large quantities of gas arising as a result of decomposition of the insulating liquid) away from the compensating apparatus in the event of a fault, it is advantageous to provide pressure dampers (DD) in the channel to the compensating apparatus. These pressure dampers (DD) can be formed from a reduction in cross section over the path of the insulating liquid to the compensating body.

At the same time, it is necessary to provide for the gases to be passed to a pressure relief valve (D2) or another pressure reduction apparatus in such a way as to cause little obstruction and delay to the discharge of the gases.

In a further particular embodiment, the compensating body is provided with a spring element (F1) in order to achieve a predetermined pressure movement. These spring elements can also be formed by the body of the compensator itself.

In a specific embodiment, the compensating apparatus is equipped with volume limiting means in one or else both directions. As a result, pressure movement corresponding to particular requirements can be realized, for example, in the switch vessel. This limitation is likewise possible as a result of the travel of the compensating elements being limited and a multi-part compensating apparatus with chambers having different spring constants.

In further embodiments, the gas cushions are designed in such a way that it is possible for them to be incorporated in functional parts of the switch and therefore only a small amount of space is required. An exemplary embodiment of this solution is the use of metal expansion bodies as the shielding electrode.

The embodiment of the compensating bodies according to the invention in the form of a metal compensator, bubble memory, roll diaphragm, foil sack, plastic diaphragm or rubber compensator is possible. As a result of the arrangement in accordance with the invention, the required compensating bodies (K) do not come into contact with the atmosphere (1), so that the corrosion of metal compensators under the influence of moisture and the aging of plastic diaphragms under the effect of moisture, oxygen and ozone are avoided. As a result, the requirements placed on the compensating bodies used are considerably reduced.

In a particularly advantageous embodiment, these displacement elements are represented by simple gas-filled balloons, whose wall is formed by a metal foil. Particularly cost-effective is the use of oil-resistant rubber or plastic or foils from the mentioned materials. In order to achieve the gas impermeability, the displacement bodies may be made from metallized plastic foil or thin metal foil. In order to achieve the required thermal and elastic properties given extremely low gas diffusion, multilayer foils can be used (for example with the use of: ethylene-chlorotrifluoroethylene copolymers/fluorinated ethylene-propylene copolymers/nitrile-butadine rubber). The materials used can likewise be provided with a textile or glass fiber inlay.

In addition, compensators are possible which have a low pressure or vacuum and are expanded or stretched via spring elements. The change in shape and volume is in this case determined by the interaction of spring force and internal compensator pressure with the switch pressure.

Advantageously, the displacement bodies are dimensioned in such a way that they are vacuum-tight in order to permit the conventional filling process for large-scale transformers. This can be provided by a combination of suitable dimensions and wall thicknesses, but also by a supporting structure, in the case of foils.

The invention will be described in more detail below with reference to exemplary embodiments.

DESCRIPTION OF THE INVENTION

Figure 1:
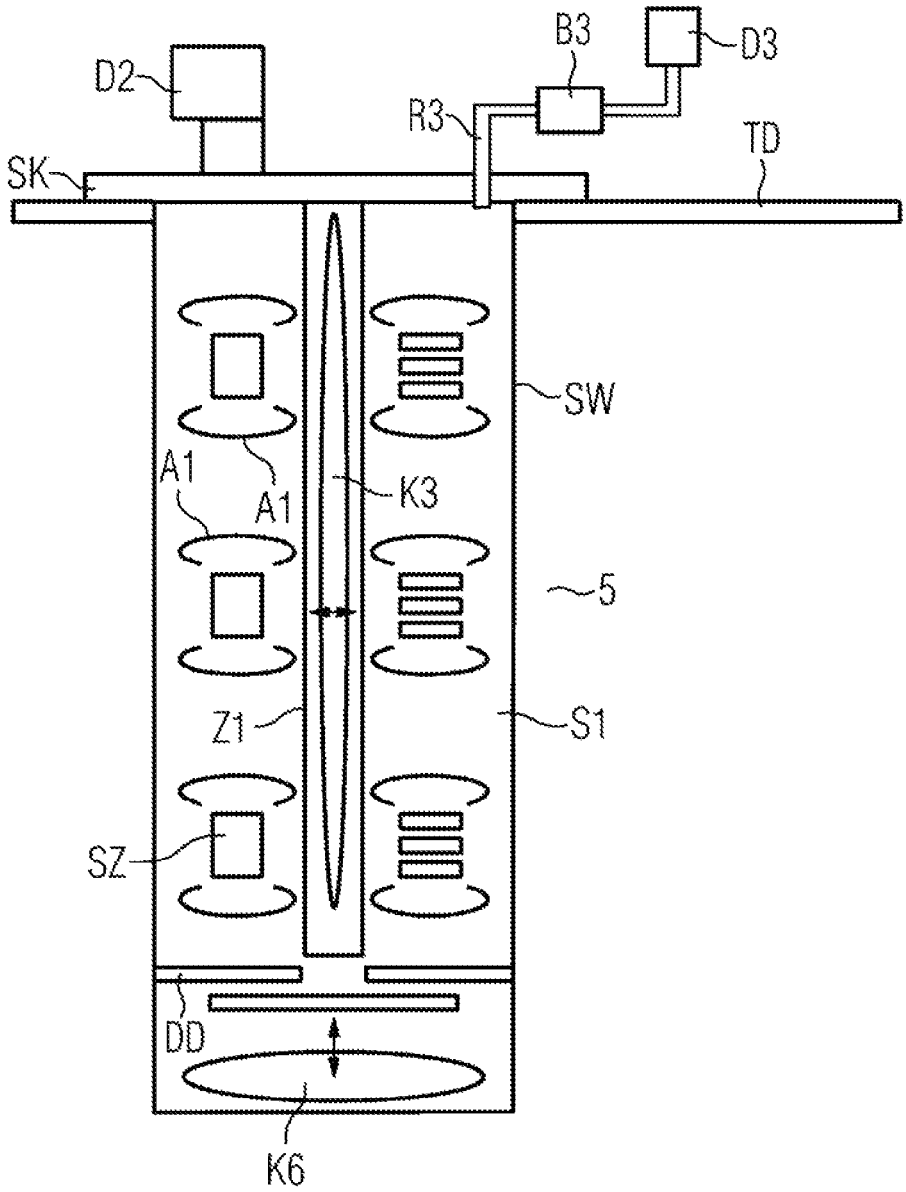
FIG. 1 is an illustration showing a switch with a switch head, which is disposed on a cover of a transformer according to the invention.

FIG. 1 shows a switch (S1) with a switch head (SK), which is arranged on the cover (TD) of a transformer. The area within the switch (S1) is filled with insulating liquid. Since the housing of the switch (SW) hermetically seals the latter, during heating of the insulating liquid of the switch there is an increase in the internal pressure in the switch. This increase in pressure causes the gas in the compensating apparatuses (K6) to be compressed. Gases which are formed by thermal decomposition of the oil rise upward and are passed to a monitoring device (B3). If the quantity of gas is too great, gas is let out via a valve (D3).

As a result of this arrangement according to the invention, the compensating body is part of the switch. Additional external components are dispensed with and result in a simplification of the entire transformer. Advantageously, component parts which are in any case present in the switch are included in the design of the compensating bodies.

Figure 2:
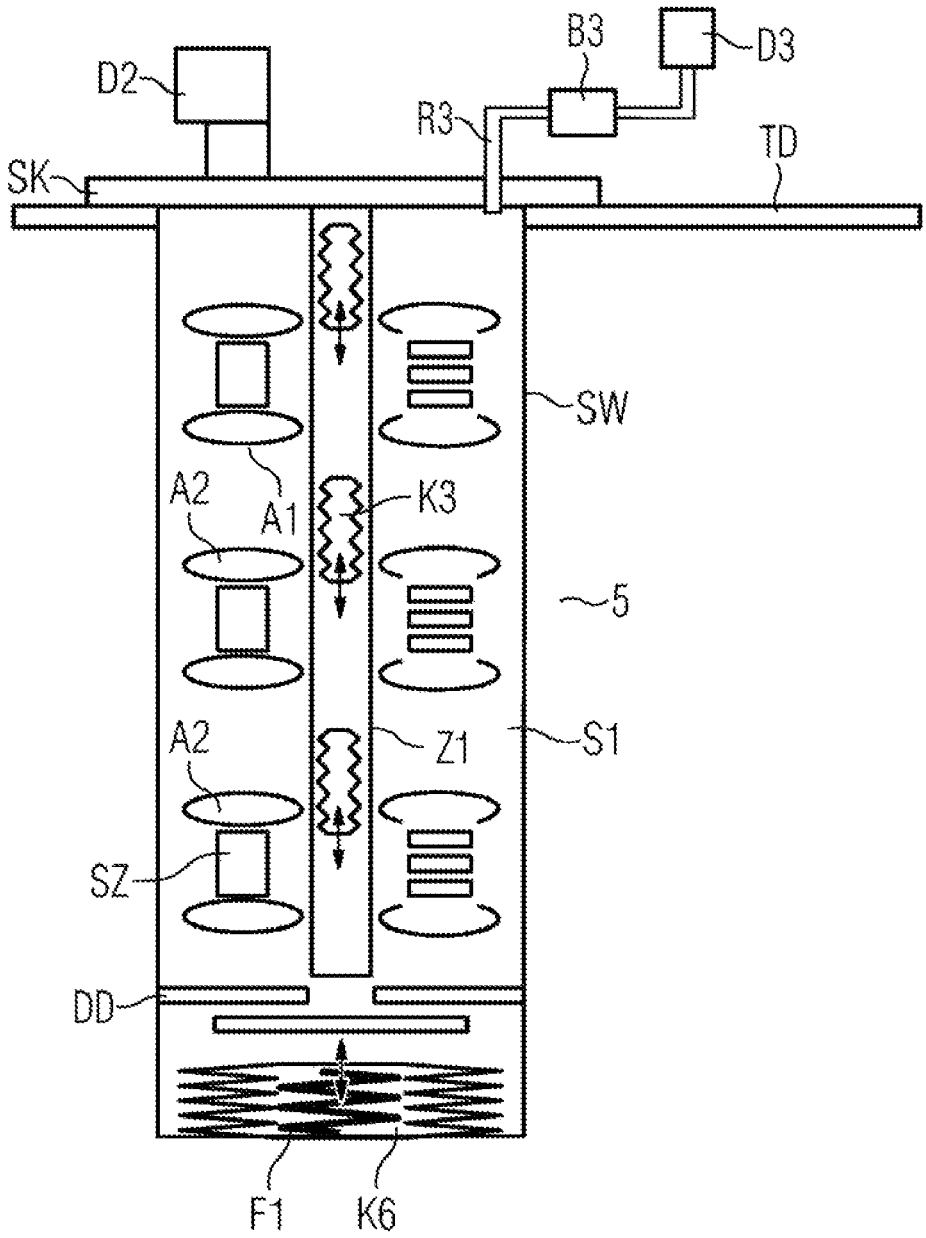
FIG. 2 is an illustration of an exemplary embodiment in which compensating bodies are formed by bellows.

FIG. 2 shows an exemplary embodiment in which the compensating bodies are formed by bellows. In the exemplary embodiment, these compensating bodies (K3, K6) are accommodated both in the lower part of the switch and in the central pipe of the switch (Z1) formed from an insulating cylinder. In the exemplary embodiment, furthermore parts of the electrical shields (A2) are in the form of metal expanding bodies.

Figure 3:
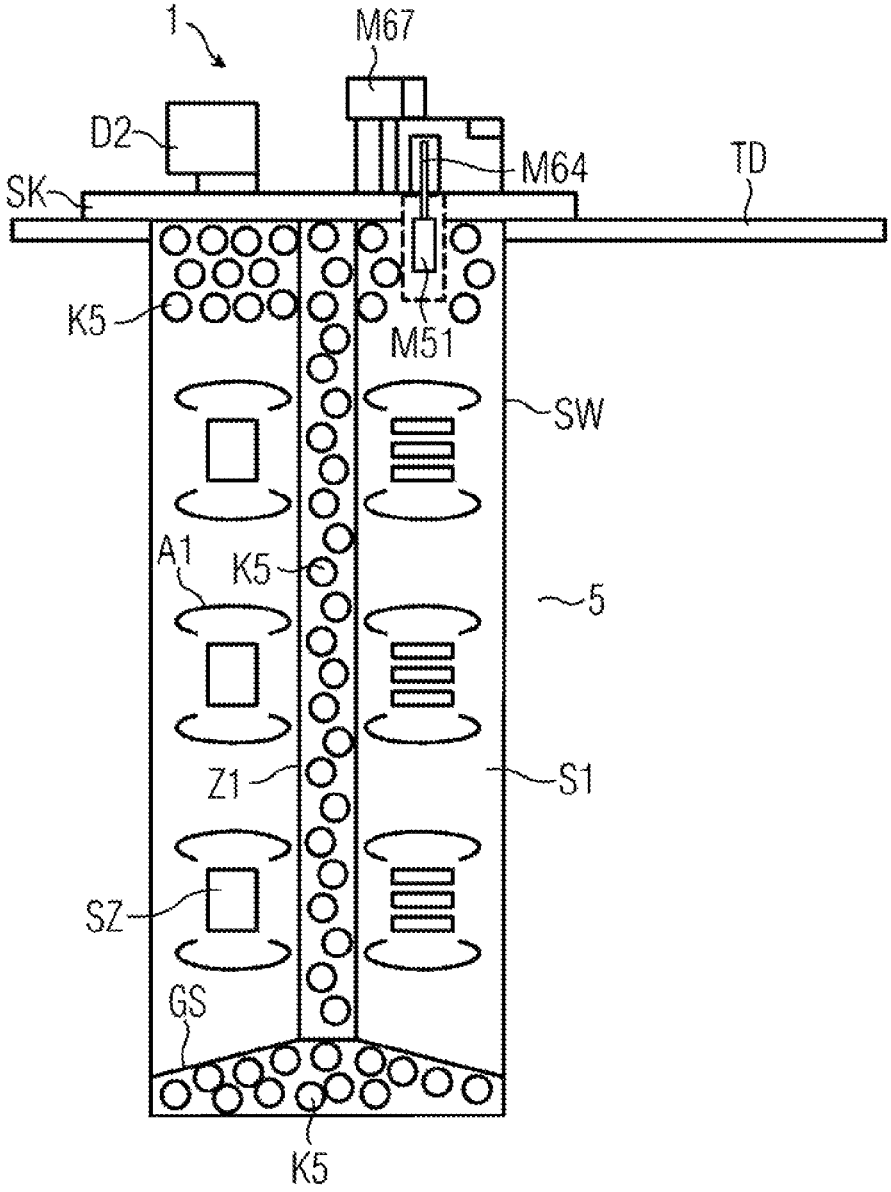
FIG. 3 is an illustration of an exemplary embodiment in which volume compensation is formed by a large number of compensating bodies.

FIG. 3 shows an exemplary embodiment in which the volume compensation is formed by a large number of compensating bodies (K5). These compensating bodies do not impede the ascent of the gases resulting from thermal decomposition of insulating liquid. In the exemplary embodiment, these gases collect in the interspaces of the compensating bodies (K5) accommodated in the head region and displace insulating liquid there. When a predetermined quantity of gas (oil level) is present, the measuring and control unit (M64) causes the gas outlet valve (M67) to open and the harmful gases enter the atmosphere (1) or an interposed evaluation unit (gas analysis). These compensating bodies can be produced in a cost-effective manner and can be introduced into various switch types in different quantities.

The compensating bodies illustrated in the exemplary embodiments can be accommodated in a very wide variety of regions of the switch. Furthermore, this embodiment makes it possible to use a large number of so-called dead spaces for volume compensation. In the exemplary embodiment, these compensating bodies are accommodated both in the head region of the switch and in the central pipe of the switch (Z1) formed from an insulating cylinder. In the event of individual cells losing their sealtightness, only these individual cells are filled with oil, and the entire system is not at risk. Escaping gas passes to the Buchholz relay and, in the event of damage to a corresponding quantity of displacement elements, results in the latter being triggered. If compensating bodies (K5) are accommodated in the lower region of the switch, a stop (GS) prevents these compensating bodies from ascending. This stop is advantageously designed in such a way that it keeps escaping gases away from electrically loaded parts in the event of defects in individual compensating bodies. Advantageously, these gases are passed in the central cylinder (Z1) or the switch shaft safely into the head region of the switch.

Figure 4:
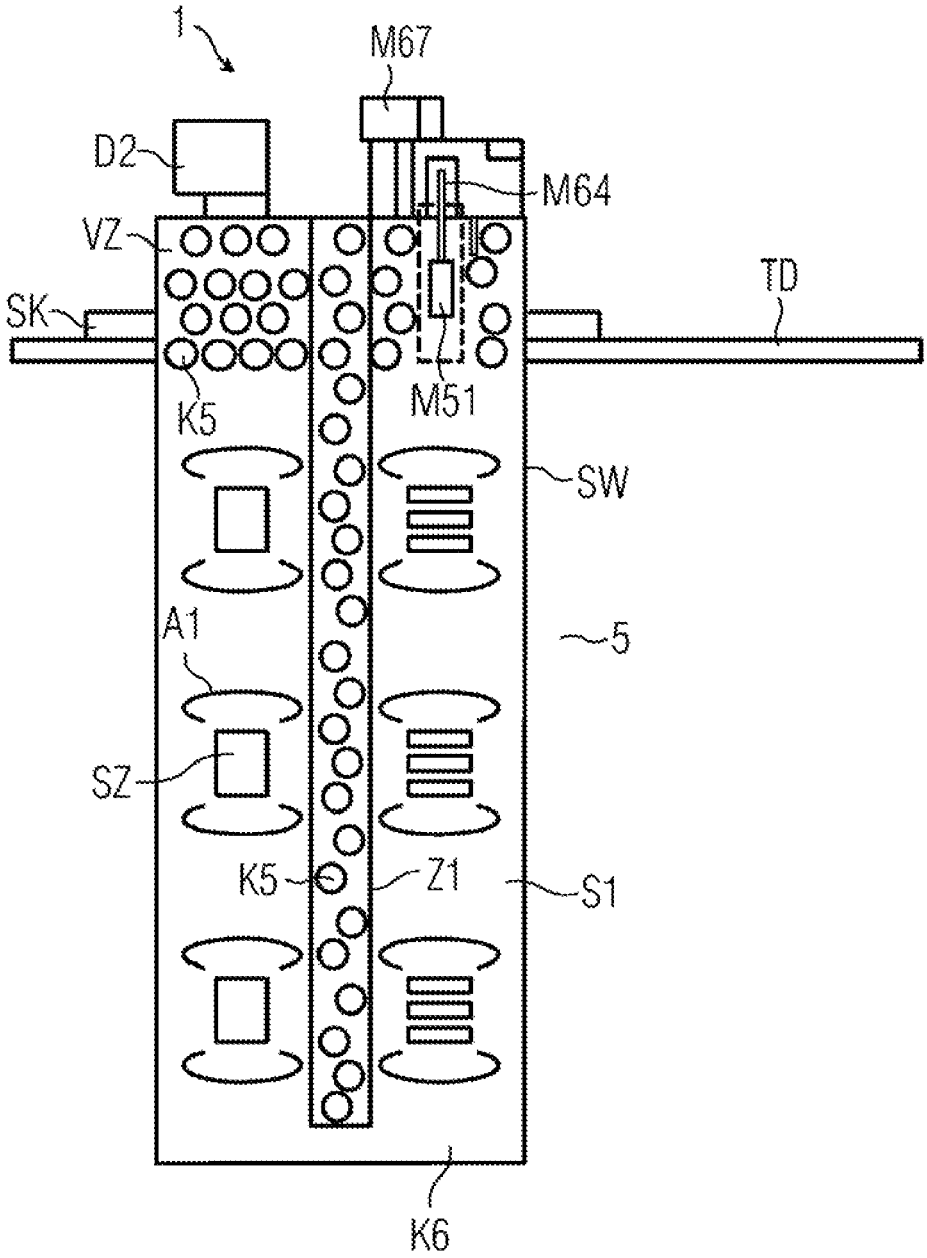
FIG. 4 is an illustration showing a switch which, in the upper region of the housing, is provided with an additional volume for accommodating a suitable quantity of additional insulating liquid in order to replace the oil lost during decomposition of the oil, for example by heating of the transition resistors.

FIG. 4 shows a switch which, in the upper region of the housing (SW), is provided with an additional volume (VZ) for accommodating a suitable quantity of additional insulating liquid in order to replace the oil lost during decomposition of the oil, for example by means of heating of the transition resistors. Since the oil volume is very small in comparison with the gas volume resulting during the decomposition, a small quantity of insulating liquid is sufficient for the period of time between main inspections. When using vacuum switching cells (SZ) it is possible, in a paricular exemplary embodiment, to accommodate the entire oil supply for the life of the switch as a result of the in this case markedly reduced, thermally induced oil decomposition. The gas resulting in the case of oil decomposition rises upward and collects in this additional area (VZ). As a result of the considerably larger gas volume, there is an excess pressure in the switch vessel. If the pressure in the switch exceeds a predetermined limit value, the gas outlet (M67), which is closed during normal operation, opens and provides pressure relief with the atmosphere (1) surrounding the switch. Advantageously, a controller (M51, M64) regulates the system in such a way that a response of the gas outlet (M67) only takes place if a predetermined quantity of gas is provided in the head region of the switch. The protection of the pressure waves is undertaken by the pressure relief valve (D2). The subsequent flow of oil from the upper part of the switch area (VZ) and the act of the gas produced being let out make possible a further degree of maintenance freedom of the switch in the case of a small physical size and complete sealing of the insulating liquid from the atmosphere and without an external oil expansion vessel being required.

Figure 5:
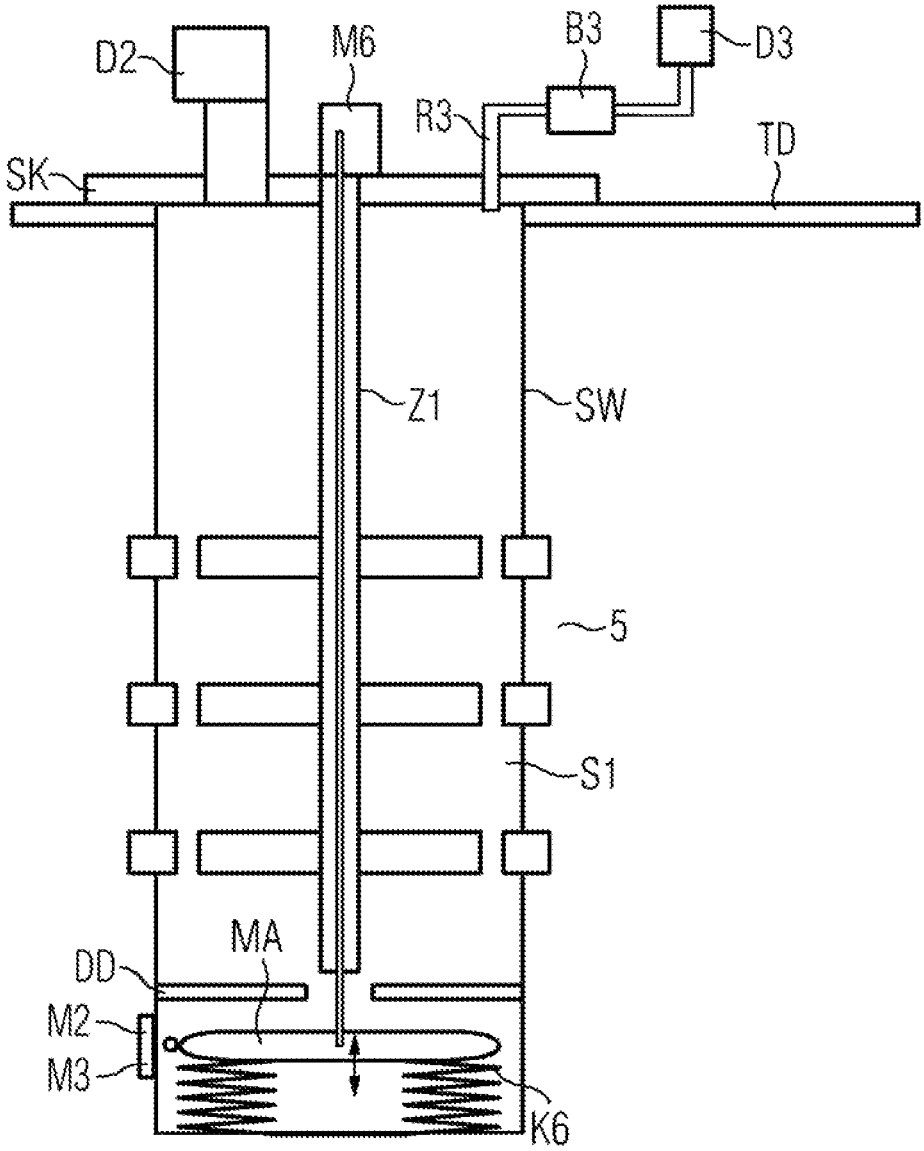
FIG. 5 is an illustration of an exemplary embodiment of a switch designed in accordance with the invention.

FIG. 5 shows an exemplary embodiment of a switch designed in accordance with the invention, in which the expansion of the compensator (K6) is transferred via a connection accommodated in the central pipe (Z1) to an evaluation unit (M6) and is used for indicating the fill level and/or pressure. Likewise illustrated is the transfer of the compensator movement via an encoder (M3) (for example: permanent magnet) to a detection unit (M2).

The invention claimed is:

1. An electric switch, comprising:

a tightly sealed housing filled with an insulating liquid; and a gas cushion containing a gas for absorbing thermally induced volume fluctuations and integrated in said housing, said gas cushion being formed by bodies, said bodies by changing shape absorb the volume fluctuations of the insulating liquid, said gas cushion having an envelopment preventing gases formed during thermal decomposition of the insulating liquid from mixing with said gas in said gas cushion, at least one of said bodies being a compensating body being at least partially electrically conductive and used as a shielding electrode/electrical shield.

2. The electric switch according to claim 1, wherein said gas cushion is formed by a plurality of compensating bodies.

3. The electric switch according to claim 2, further comprising:

a flow channel for bubbles disposed in said housing;

a cover covering said compensating bodies; and electric functional parts disposed in said housing, said compensating bodies disposed beneath said electric functional parts, said electric functional parts being protected from gas bubbles escaping as a result of sudden or gradual loss of said gas from said compensating bodies by said compensating bodies being covered by said cover and said flow channel for channeling gas bubbles.

4. The electric switch according to claim 2, wherein said gas cushion is a compensating body having a spring element to achieve a predetermined pressure movement.

5. The electric switch according to claim 1, further comprising a shutoff device support by said housing, when a specific pressure in an interior of said housing is exceeded, excess pressure is reduced by said shutoff device being opened.

6. The electric switch according to claim 1, further comprising a gas outlet valve controlled such that said gas outlet valve does not actuate when the insulating liquid is applied, said gas outlet valve connected to said housing.

7. The electric switch according to claim 1, wherein an insulating liquid volume of the electric switch is reduced by introducing displacement bodies.

8. The electric switch according to claim 1, further comprising vacuum switching cells disposed in said housing.

9. The electric switch according to claim 1, wherein said gas cushion is a compensating apparatus formed with an elastic diaphragm.

10. The electric switch according to claim 9, wherein said compensating apparatus is selected from the group consisting of metal compensators and bellows.

11. The electric switch according to claim 1, further comprising pressure wave dampers disposed in said housing, said gas cushion is a volume compensating apparatus protected from pressure waves by said pressure wave dampers.

12. The electric switch according to claim 11, wherein said pressure wave damper forms a reduction in cross section in a feed path to said volume compensating apparatus.

13. The electric switch according to claim 1, further comprising apparatuses for detecting at least one of a fill level of the insulating liquid and a pressure, said apparatuses supported by said housing.

14. The electric switch according to claim 13, wherein said bodies are compensating elements and a deformation of said compensating elements brought about by a change in volume of the insulating liquid is used for at least one of evaluating and indicating an insulating liquid volume.

15. The electric switch according to claim 1, further comprising apparatuses for collecting and for draining gases forming in said housing.

16. The electric switch according to claim 15, wherein said apparatuses are controlled in dependence on an insulating liquid level in said housing.

17. The electric switch according to claim 2, further comprising stops disposed in said housing and undesirable changes in positions of said compensating bodies brought about by a lifting force are avoided by said stops.

18. The electric switch according to claim 1, wherein said housing has an added volume for accommodating a small quantity of additional insulating liquid to replace the insulating liquid lost in a case of decomposition as a result of at least one of switching operations and heating of transition resistors.

* * * * *